US012723390B2

(12) United States Patent
Montanaro et al.

(10) Patent No.: US 12,723,390 B2
(45) Date of Patent: Sep. 1, 2026

(54) FITTING, PIECE OF BATHROOM OR KITCHEN FURNITURE COMPRISING SAID FITTING, AND METHOD FOR OPENING AND CLOSING A DRAIN IN A PIECE OF BATHROOM OR KITCHEN FURNITURE

(71) Applicant: Franke Technology and Trademark Ltd, Hergiswil (CH)

(72) Inventors: Francesco Montanaro, Aarburg (CH); Rolf Neeser, Reidermoos (CH)

(73) Assignee: Franke Technology and Trademark Ltd, Hergiswil (CH)

( * ) Notice: Subject to any disclaimer, the term of this patent is extended or adjusted under 35 U.S.C. 154(b) by 182 days.

(21) Appl. No.: 18/713,302

(22) PCT Filed: Nov. 21, 2022

(86) PCT No.: PCT/EP2022/082614
§ 371 (c)(1),
(2) Date: May 24, 2024

(87) PCT Pub. No.: WO2023/094317
PCT Pub. Date: Jun. 1, 2023

(65) Prior Publication Data

US 2025/0019949 A1 Jan. 16, 2025

(30) Foreign Application Priority Data

Nov. 24, 2021 (DE) ..... 102021130830.5

(51) Int. Cl.
*E03C 1/23* (2006.01)

(52) U.S. Cl.
CPC .... *E03C 1/2304* (2013.01); *E03C 2001/2315* (2013.01)

(58) Field of Classification Search
CPC ..... E03C 1/23–2308; E03C 2001/2311–2317; F16K 31/465
See application file for complete search history.

(56) References Cited

U.S. PATENT DOCUMENTS 1,335,946 A * 4/1920 Watrous ..... E03C 1/2302 137/637
1,821,260 A * 9/1931 Dobrick ..... E03C 1/23 137/606

(Continued)

FOREIGN PATENT DOCUMENTS

CH 158482 * 11/1932 ..... E03C 1/2302
CH 158482 A 11/1932

(Continued)

*Primary Examiner* — David P Angwin
*Assistant Examiner* — Nicholas A Ros
(74) *Attorney, Agent, or Firm* — Volpe Koenig

(57) ABSTRACT

A fitting (10), in particular for a piece of kitchen or bathroom furniture (40), having a main body (11) which in the assembled state of the fitting (10) protrudes substantially perpendicularly from an assembly face (30), and having an activation device for a drain, which activation device is disposed on the fitting (10) and interacts with a force-transmission element (13) by which a drain plug (20) is able to be operated, and which activation device includes a handling element (13) which is disposed on the fitting (10) so as to be movable, preferably rotatable or pivotable, relative to the rest of the fitting (10). The fitting (10) is distinguished in that the handling element (13) is movable, preferably rotatable or pivotable, about an activation axis which is substantially perpendicular to a longitudinal axis (L) of the main body (11), so as to mechanically act on the force-transmission element (15).

16 Claims, 5 Drawing Sheets

(56) References Cited

U.S. PATENT DOCUMENTS

| | | | | | |
|---|---|---|---|---|---|
| 2,063,632 | A * | 12/1936 | Schneider | E03C 1/2302 | 4/689 |
| 3,763,504 | A * | 10/1973 | Parsons | E03C 1/2304 | 4/673 |
| 6,973,685 | B2 * | 12/2005 | Duncan | E03C 1/23 | 4/689 |
| 2012/0312401 | A1 * | 12/2012 | Gioira | E03C 1/04 | 285/125.1 |
| 2022/0042292 | A1 * | 2/2022 | Ahuja | A47K 1/14 | |

FOREIGN PATENT DOCUMENTS

| | | | | |
|---|---|---|---|---|
| CN | 110629839 | * | 12/2019 | E03C 1/2304 |
| CN | 113802654 | * | 12/2021 | E03C 1/2304 |
| DE | 840227 | B | 4/1952 | |
| DE | 202015009268 | U1 | 1/2017 | |
| EP | 1134321 | A2 | 9/2001 | |
| EP | 3988725 | A1 | 4/2022 | |
| GB | 974957 | A | 11/1964 | |
| GB | 1430234 | A | 3/1976 | |
| JP | 2011006971 | * | 1/2011 | E03C 1/2304 |
| KR | 20057178 | * | 12/2001 | E03C 1/23 |

* cited by examiner

FITTING, PIECE OF BATHROOM OR KITCHEN FURNITURE COMPRISING SAID FITTING, AND METHOD FOR OPENING AND CLOSING A DRAIN IN A PIECE OF BATHROOM OR KITCHEN FURNITURE

CROSS-REFERENCE TO RELATED APPLICATIONS

This application is a 371 National Phase of PCT/EP2022/082614, filed Nov. 21, 2022, which claims priority from German Patent Application No. 10 2021 130 830.5, filed Nov. 24, 2021, both of which are incorporated herein by reference in their entirety as if fully set forth.

TECHNICAL FIELD

The invention relates to a fitting, in particular for a piece of kitchen or bathroom furniture.

The invention furthermore relates to a piece of bathroom or kitchen furniture having a fitting according to the invention.

Finally, the invention also relates to a method for opening and closing a drain in a piece of bathroom or kitchen furniture.

BACKGROUND

Known from DE 20 2015 009 268 U1 is a fitting, in particular for a piece of kitchen or bathroom furniture, which has a fastening portion, a faucet portion, and a drain portion, and an opening and closing device, disposed in the fitting, for a drain. The opening and closing device interacts with a force-transmission means by way of which a drain plug is able to be operated. The previously known fitting is characterized in that the opening and closing device comprises a handling element which is disposed on the periphery of the fitting and is rotatable about a longitudinal axis of the fitting, or of the fastening portion, respectively.

It is to be considered disadvantageous herein that rotating the handling element about the longitudinal axis of the fitting, i.e. about the vertical, is unsatisfactory in ergonomic terms, and therefore rather uncomfortable for an operator.

The company GUGLIELMI S.p.A. Rubinetterie offers kitchen fittings designated "SMARTAP", by way of which a drain plug is electrically activatable by pressing a button. Here, especially the increased complexity in terms of assembly, in particular for the electrical connection and the corresponding motorized means, in association with the increased costs are to be considered disadvantageous.

SUMMARY

The invention is based on the object of addressing these issues and of specifying a fitting, a piece of bathroom or kitchen furniture, and a method for opening and closing a drain in such a piece of furniture, with the aid of which the aforementioned disadvantages can be avoided, so as to achieve in particular improved ergonomics in terms of handling, and to reduce the complexity in terms of assembly and costs, respectively.

This object is achieved according to the invention by a fitting having one or more of the features disclosed herein, by a piece of furniture having one or more of the features disclosed herein, and by a method having one or more of the features disclosed herein.

Advantageous refinements of the respective subject matter of the invention are defined below and in the claims.

According to the invention, a fitting, in particular for a piece of kitchen or bathroom furniture, having a main body which in the assembled state of the fitting protrudes substantially perpendicularly from an assembly face, and having an activation device for a drain, which activation device is disposed on the fitting and interacts with a force-transmission means by way of which a drain plug is able to be operated, and which activation device comprises a handling element which is disposed on the fitting so as to be movable, preferably rotatable or pivotable, relative to the rest of the fitting, is characterized in that the handling element is movable, in particular rotatable or pivotable, about an activation axis which is substantially perpendicular to a longitudinal axis of the main body, so as to mechanically act on the force-transmission means.

When mention is made herein that the fitting in the assembled state by way of its main body extends "substantially" perpendicularly to the assembly face, this is also intended to include design embodiments in which an angle between the main body of the fitting and the assembly face deviates from 90° to a certain degree. It is essential that the fitting by way of its main body protrudes from the assembly face.

Furthermore, when mention is made that the handling element is movable about an activation axis, which activation axis is oriented so as to be "substantially" perpendicular to the longitudinal axis of the main body of the fitting, this is also intended to include design embodiments in which a corresponding angle deviates from 90° by a certain degree. It is essential that the mentioned activation axis of the handling element does not coincide with the longitudinal axis of the main body, as was the case in the prior art, which led to disadvantages in terms of the ergonomics that could be achieved.

Moreover, when mention is made that the handling element is movable about the activation axis, this is intended to include in particular rotating or pivoting of the handling element. However, this does also not preclude a compressive effect, the action on the force-transmission means however being in each case mechanical.

In the context of an extremely preferred design embodiment of the fitting according to the invention it is however provided that the handling element is designed to be rotatable about the activation axis. According to the findings of the applicant, particularly positive operating ergonomics can be achieved as a result.

In the context of another design embodiment of the fitting according to the invention it can be provided that the handling element, conjointly with a (single lever) mixing faucet of the fitting, is disposed on, or along, an axis which in the assembled state of the fitting runs substantially parallel to the assembly face. The handling element can in particular be disposed exactly opposite the mixing lever on the fitting. This results in an object which is particularly advantageous in terms of its aesthetic effect as well as in terms of the operating ergonomics.

In the context of yet another design embodiment of the fitting according to the invention it can be provided that the handling element has a profiled and/or structured external circumferential face, preferably about the entire circumference. It can be ensured in this way that an operator can activate, in particular rotate, the handling element even with damp hands, without slipping in the process.

Yet another refinement of the fitting according to the invention provides that the external circumferential face is designed to be circular-cylindrical. Such a design embodiment furthermore contributes to a particularly comfortable operation.

It has been demonstrated to be particularly advantageous for the fitting according to the invention, in the context of a further design embodiment, on the external circumferential face to have a display structure, e.g. an elevation, for displaying a movement position relative to the rest of the fitting. In this way, an operator can easily identity the functional position in which the handling element is currently situated, even in the dark or without a visual check, this being advantageous in particular when the external circumferential face is designed to be circular-cylindrical and does not have a preferred direction per se.

In an extremely advantageous refinement of the fitting according to the invention it is provided that the force-transmission means is at least in portions designed to be flexible, preferably as a Bowden cable, and most preferably guided within a casing. Such force-transmission means are known per se; they can be designed in a simple and cost-effective manner, and can by virtue of their flexibility be used even in difficult or tight space conditions. Despite the flexibility, a sufficient transmission of force for opening or closing a drain is readily possible in particular by virtue of the casing mentioned. However, it is also within the scope of the invention that the force-transmission means is at least in portions designed to be a fixed or rigid connection, for example as a rigid bar, preferably in a plurality of parts with suitable articulated connections.

In another extremely advantageous refinement of the fitting according to the invention it is provided that the force-transmission means, preferably on its end, has a sliding part, which sliding part is movable within the casing, and that an elastomer element, in particular an annular seal or O-ring, which ensures a sufficient degree of friction in terms of the casing is disposed on the sliding part. As a result, it can be prevented that the drain plug closes itself (e.g. due to suction or water pressure, etc.).

When the force-transmission means in another refinement of the fitting according to the invention is designed from a plurality of at least two parts, which parts are preferably releasably connected or connectable to one another, e.g. hooked and/or screwed to one another, this results in a simplified installation, and the fitting according to the invention, or the force-transmission means, is potentially also able to be retro-fitted to already existing pieces of bathroom or kitchen furniture.

In order to guarantee the mechanical activation of the drain plug, an extremely preferred refinement of the fitting according to the invention provides that the force-transmission means is in mechanical terms operatively connected to the handling element at a spacing from the activation axis. As a result of such an eccentric design embodiment in terms of the activation axis, a rotating or pivoting movement of the handling element can in particular be converted into a translatory movement of the force-transmission means, said translatory movement being able to be transformed to an up-and-down movement of the drain plug in a manner known per se—for example by way of a suitable lever assembly.

In yet another refinement of the fitting according to the invention it can also be provided that the handling element on its internal side facing the fitting main body has a clearance, the force-transmission means engaging in said clearance by way of a fastening end. A secure connection between the handling element and the force-transmission means can be achieved in this way, without compromising the comfortable operation or entailing aesthetic disadvantages.

It can be provided especially in a corresponding refinement of the fitting according to the invention that the force-transmission means on its fastening end has a pin which extends perpendicularly to the force-transmission means. Such a pin can ensure the already mentioned secure connection between the handling element and the force-transmission means.

It has proven extremely advantages for the clearance in a further design embodiment of the fitting according to the invention to be designed to be curved, wherein a profile of the clearance preferably deviates from the profile of a circle which is concentric with the activation axis. It can be achieved in this way that the force-transmission means only performs a substantially purely translatory movement—despite a rotating or pivoting movement of the handling element—which can have a positive effect in terms of the force to be applied by the operator and the durability of the arrangement.

Yet another refinement of the fitting according to the invention provides that the profile of the clearance is longer than a corresponding dimension of the fastening end, preferably of a diameter of the pin mentioned. A type of gate guide for the pin, or for the fastening end, respectively, is derived in this way, so that in the context of yet another refinement of the fitting according to the invention the fastening end, preferably the pin mentioned, is guided in the clearance when the handling element is rotationally activated. Depending on the length of the clearance, this can thus result in a certain delay in terms of activation, which can ensure inter alia that not every slight physical contact/movement of the handling element immediately leads to the drain being opened or closed.

It has proven particularly advantageous herein that, in a corresponding design embodiment of the fitting according to the invention, the fastening end of the force-transmission means performs a movement which is substantially perpendicular to the assembly face, or in the direction of the main body longitudinal axis, respectively, without the invention being limited to a design embodiment of this type—in particular with a view to the already mentioned flexibility of the force-transmission means.

According to a second aspect of the present invention, a piece of bathroom or kitchen furniture having a water basin which has a drain that is closed, or able to be closed, by a drain plug, comprises an assembly face for a fitting, and a fitting assembled on this assembly face, which fitting is designed as a fitting according to the invention and by way of the force-transmission means is connected to the drain plug, and/or to an opening and closing device for the drain plug, wherein the activation axis of the fitting is preferably oriented so as to be substantially parallel to the assembly face.

Reference to the advantages which can be achieved with such a construction has already been made in detail above with reference to the fitting according to the invention. In principle, there is the possibility of upgrading an existing piece of bathroom or kitchen furniture to a piece of bathroom or kitchen furniture according to the invention by installing a fitting according to the invention.

According to a third aspect of the present invention, a method for opening and closing a drain in a piece of bathroom or kitchen furniture having a water basin, which drain is closed, or able to be close, by a drain plug, comprises the following steps:

a) attaching a fitting according to the invention to an assembly face of the piece of furniture;

b) connecting the force-transmission means of the fitting to the drain plug and/or to an opening and closing device for the drain plug; and c) moving, in particular rotating or pivoting, the handling element about the activation axis of the fitting, wherein the activation axis of the fitting is preferably oriented so as to be substantially parallel to the assembly face.

The advantages that can be achieved by such a method are also derived from the description above of the fitting according to the invention and the advantageous refinements of said fitting.

The general concept on which the invention is based is accordingly the opening and closing of the outflow (drain) of a sink or of a wash basin with the aid of the faucet, or the fitting, respectively, in particular and without limitation in the kitchen.

According to the above description, the invention provides that the outflow, or the drain, of the (sink) basin is opened and closed by the action of a mechanical control integrated into the fitting. The outflow of the basin is in mechanical terms operatively connected to the force-transmission means, which is activated by the handling element of the fitting and mechanically closes or opens the outflow system in the manner of a "remote control". This remote control preferably activates the opening and closing by means of a rotating movement, as described at the outset. However, the invention is not limited to a (preferable) rotating movement of the control, or of the handling element, respectively, but can in principle also be implemented with other types of movement (pivoting, pressing, pulling or the like), as has already been pointed out.

BRIEF DESCRIPTION OF THE DRAWINGS

Further characteristics and advantages of the invention are derived from the description hereunder of exemplary embodiments by means of the drawing. In the figures.

DETAILED DESCRIPTION

Figure 1:
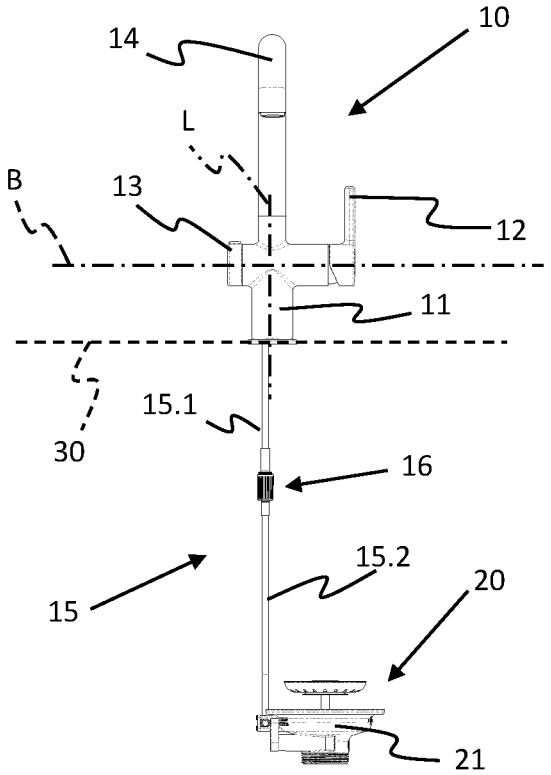
FIG. 1 shows a fitting according to the invention conjointly with a drain plug to be operated.

A fitting 10 according to the invention is illustrated conjointly with a drain plug 20 in FIG. 1, wherein the latter also comprises an associated opening and closing device denoted by the reference sign 21.

Figure 5:
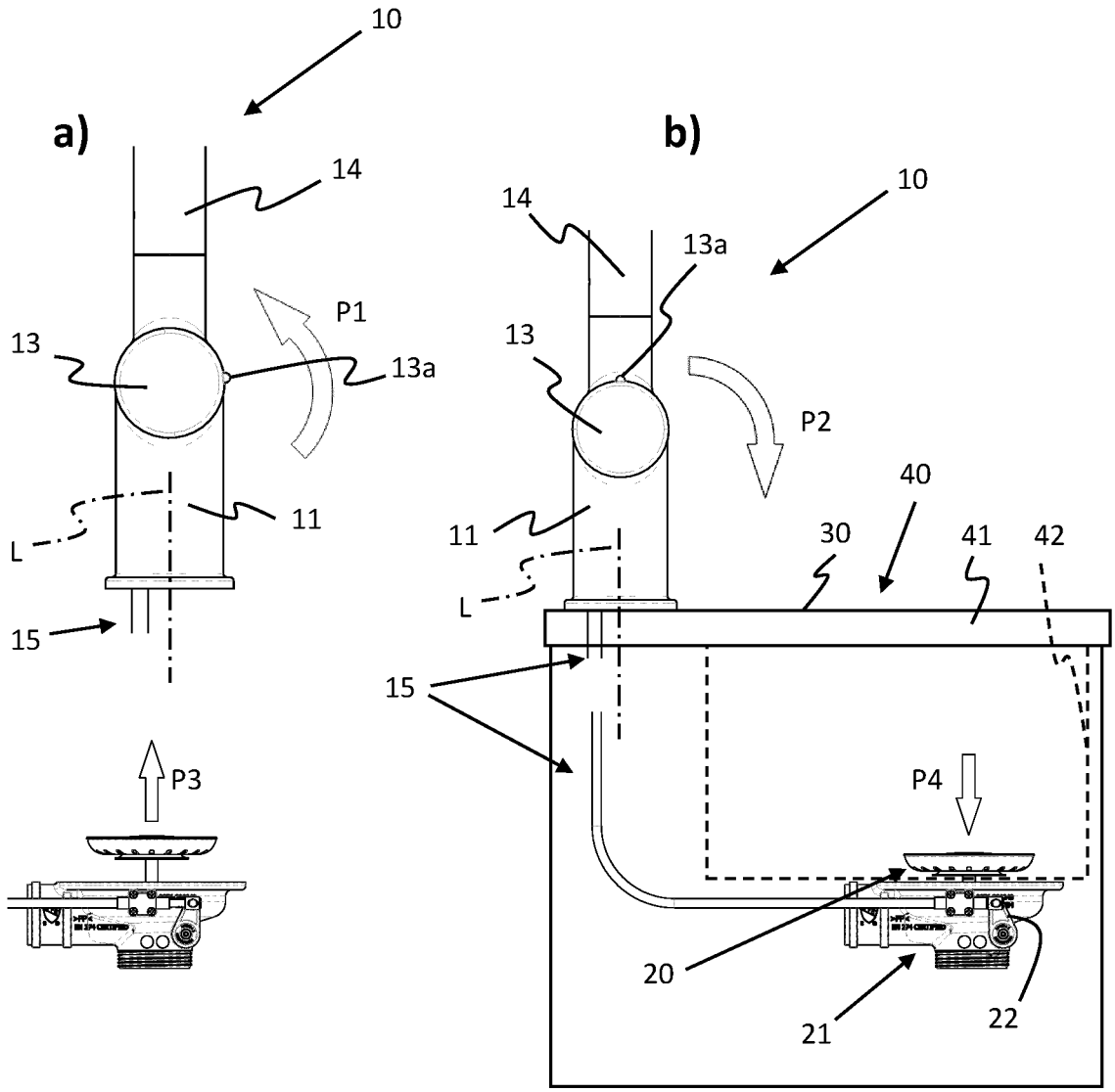
FIG. 5 shows in particular further details of a piece of furniture according to the invention.

The fitting 10 is specified for assembly on a horizontal assembly face 30, which assembly face 30 is only schematically illustrated in FIG. 1 (cf. FIG. 5). The fitting 10, in its assembled state, by way of a longitudinal axis L of its main body 11, extends perpendicularly to the assembly face 30. A single mixing lever 12 is provided laterally on the fitting 10; a handling element 13 for activating the drain plug 20 is located exactly opposite. The handling element 13 is rotatable about an activation axis B, which activation axis B is oriented perpendicularly to the longitudinal axis L of the fitting main body 11. An outflow of the fitting 10, which is fundamentally of any arbitrary shape, adjoins the fitting main body 11 in a manner known per se, which outflow is denoted by the reference sign 14 in FIG. 1.

The fitting 10, or the handling element 13, respectively, is operatively connected to the drain plug 20, or the opening and closing device 21, respectively, by way of a force-transmission means 15 designed as a Bowden cable. The force-transmission means 15 is able to be divided into two parts 15.1, 15.2 at reference sign 16, in particular by releasing a corresponding threaded connection. The first part 15.1 is connected to the handling element 13, the second part 15.2 is connected to the drain plug 20. The first part 15.1 can be designed as a rigid bar, while the second part 15.2 can preferably be designed as a flexible element (in particular a Bowden cable).

Figure 2:
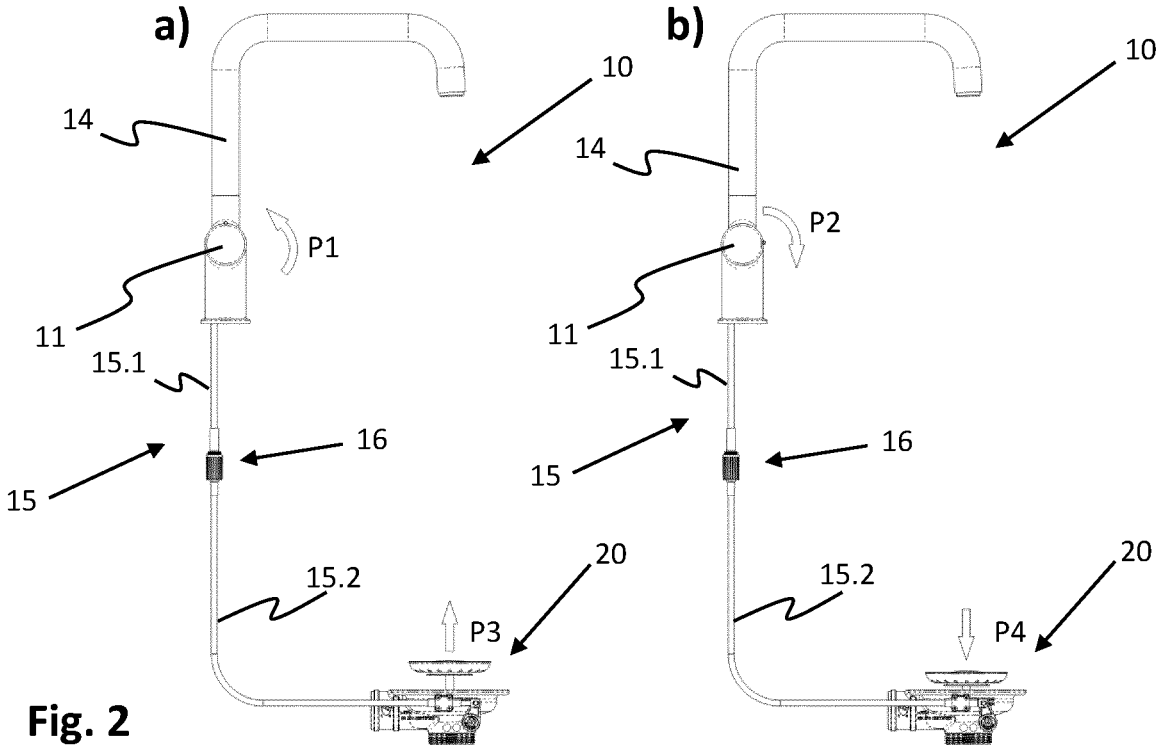
FIG. 2 shows two operating procedures which can be carried out by means of the fitting from FIG. 1.

Two possible activations of the fitting 10 are illustrated in the drawing in FIG. 2, when viewed in the direction along the activation axis B (cf. FIG. 1). The mentioned activations are symbolized by arrows P1 and P2, respectively. The partial image a) (left) shows a rotating of the handling element 13 according to the arrow P1, in the counter-clockwise direction, as a result of which the drain plug 20 is raised according to the stipulation by the force-transmission means 15 (arrow P3). The reverse is illustrated in the partial image b) (right): when the handling element 13 is rotated in the clockwise direction according to the arrow P2, the drain plug 20 is lowered according to the stipulation by the force-transmission means 15 (arrow P4).

Figure 3:
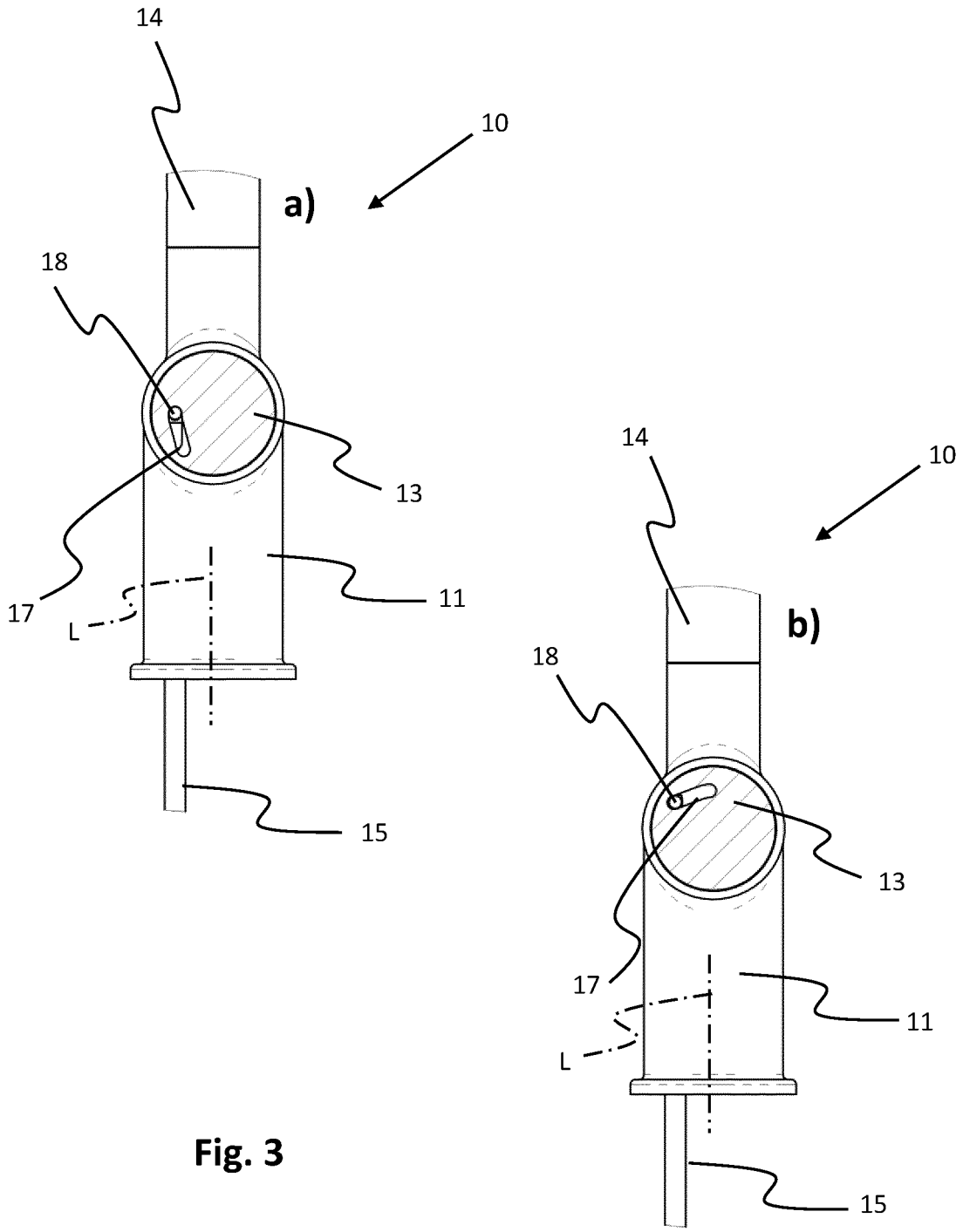
FIG. 3 shows sectional views in the region of the handling element in a fitting according to the invention.

FIG. 3 shows detailed illustrations of the fitting 10 according to FIG. 2 in a sectional view in the region of the handling element 13, wherein the sectional plane is in each case oriented perpendicularly to the activation axis B (cf. FIG. 1). As can be seen, the handling element 13, on its internal side facing the main body 11, has a curved clearance 17 in which the force-transmission means 15 engages by way of a pin 18 disposed on an end (on a corresponding fastening end). The clearance 17 represents a type of gate guide for the pin 18 so that the latter, and conjointly the force-transmission means 15, moves substantially parallel to the longitudinal axis L of the main body 11 when the handling element 13 is rotated. The left partial image a) herein corresponds to the partial image a) in FIG. 2, while the right partial image b) corresponds to the partial image b) in FIG. 2. When the handling element 13 is rotated, the pin 18 initially moves within the clearance 17 until said pin 18 stops at the end of said clearance 17 and is correspondingly entrained, this resulting in a corresponding movement of the force-transmission means 15.

The movement of the force-transmission means 15 can be influenced by the type of the curvature and the profile/the length of the clearance 17. The length of the clearance 17 ensures that a force does not act immediately on the force-transmission means 15, especially when the rotating direction of the handling element 13 changes.

Figure 4:
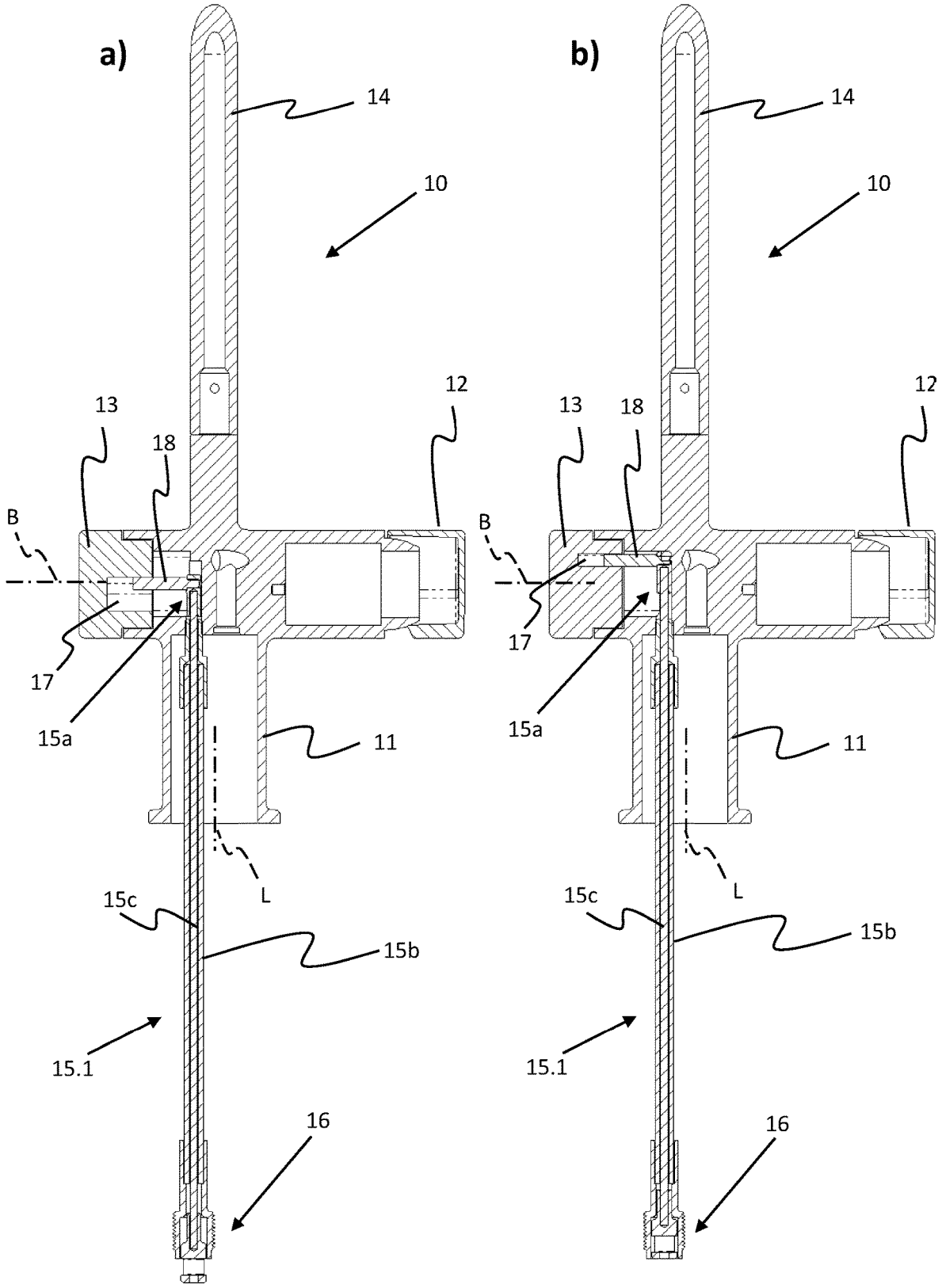
FIG. 4 shows sectional views in a plane perpendicular to the illustration in FIG. 3.

FIG. 4 shows sectional views of the fitting 10 from FIG. 1 in two partial images a) and b), wherein the sectional plane is in each case oriented perpendicularly to the sectional plane according to FIG. 3 (the sectional plane in FIG. 4 extends parallel to a plane which is defined by the axes L and B). The partial images a) and b) correspond to the partial images in FIGS. 2 and 3.

Only those particularities from FIG. 4 that are relevant to the invention are to be discussed in more detail at this point:

The pin 18 and its interaction with the clearance 17 of the handling element 13 can readily be seen in FIG. 4. The pin 18 is disposed on a fastening end 15*a* of the force-transmission means 15 and extends perpendicularly to an extent of the force-transmission means 15. Only the first part 15.1 of the force-transmission means 15 is illustrated in FIG. 4. A threaded connection for connecting the second part 15.2 of the force-transmission means 15 can be seen at reference sign 16 (cf. FIG. 1). It can furthermore be seen that the actual force-transmission means 15 (presently a rigid bar 15*c*) is guided within a casing 15*b* in the region 15.1. The bar moves within the casing 15*b* and in this way ensures (indirectly) an activation of the drain plug 20 (cf. FIG. 1).

The two possible activations of the fitting 10, or of the handling element 13, respectively, are finally likewise illustrated again in two partial images a) and b) in FIG. 5 (cf. FIG. 2).

The right partial image b) in FIG. 5 additionally schematically shows a piece of bathroom or kitchen furniture 40 having an upper worktop 41, the upper side thereof forming the assembly face 30 which has already been schematically shown in FIG. 1. The piece of furniture 40 comprises at least one (water) basin 42 having a drain which is not illustrated in more detail, the drain plug 20 including the opening and closing device 21 being disposed in the region of said drain. This device 21 has a suitable lever assembly at reference sign 22, said assembly being in mechanical terms operatively connected to the force-transmission means 15. In this way, rotating the handling element 13 according to the arrows P1, P2 ensures opening or closing of the drain plug 20 according to the arrows P3, P4—as has already been described.

Shown at reference sign 13*a* is in each case also an elevation on the periphery of the handling element 13, or on the external circumferential face thereof, which elevation as a display structure displays in which movement position relative to the rest of the fitting 10 the handling element 13 is currently situated, or in which position (open/closed) the drain plug 20 is currently situated.

Figure 6:
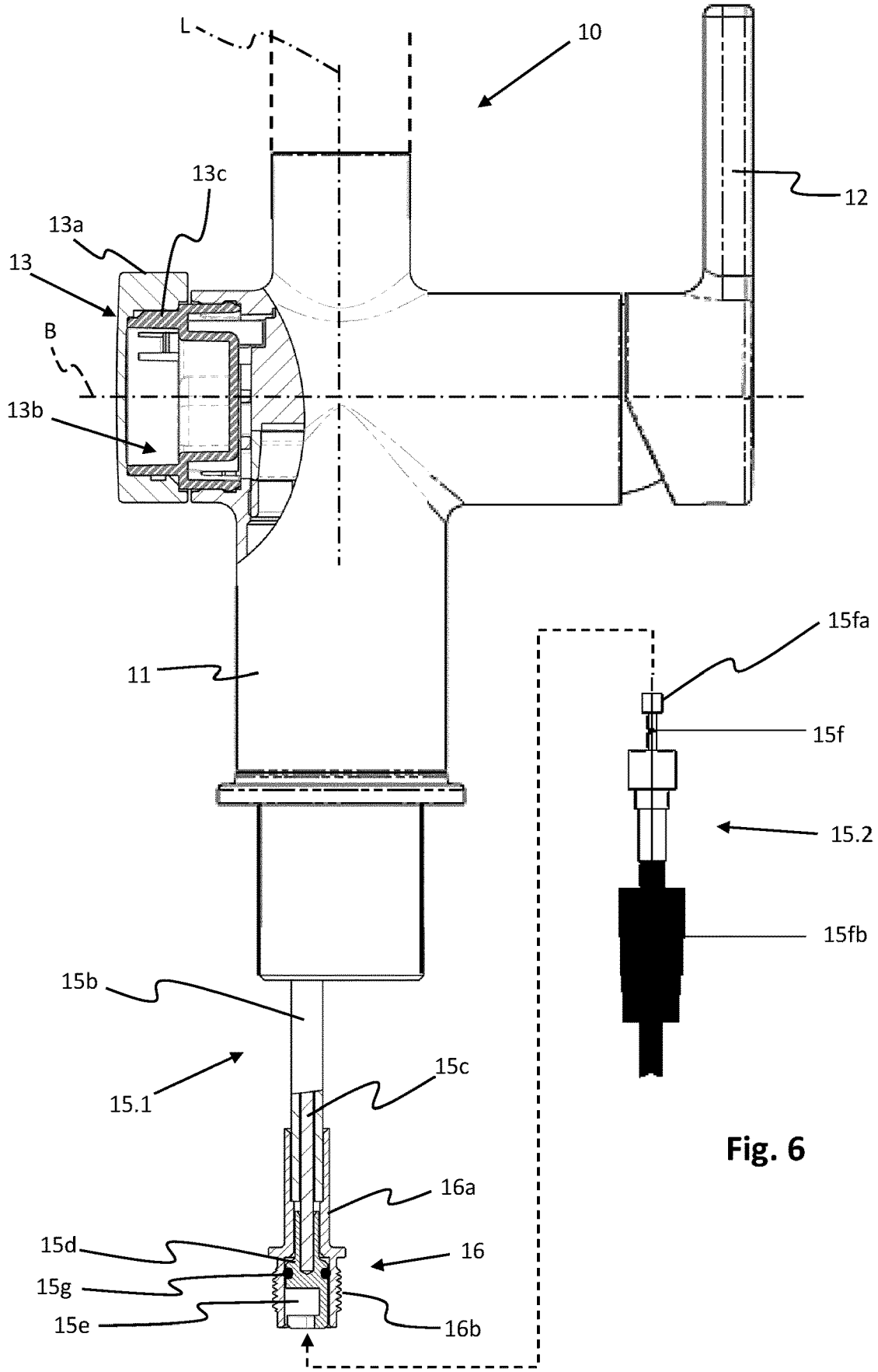
FIG. 6 shows further details of the fitting according to the invention.

FIG. 6 highlights a few further particularities of a design embodiment of the fitting 10 according to the invention. The force-transmission means 15 in its first part 15.1 again has a rigid bar 15*c* which is guided in the casing 15*b*. A sleeve 16*a*, which functions as an extension of the casing 15*b* and has an external thread 16*b*, is disposed on the lower end of the casing 15*b*. A sliding part 15*d* is disposed on a lower end of the bar 15*c*, which sliding part 15*b* is movable within the sleeve 16*a* and has a mechanical interface 15*e* for connecting to a Bowden cable 15*f*, which Bowden cable 15*f* forms the second part 15.2 of the force-transmission means 15. The sliding part 15*d* can be screwed onto the end of the bar 15*c*. The connection to the Bowden cable 15*f* is performed by hooking in a thickening 15*fa* on the end of the Bowden cable in the region of the interface 15*e* (see the dashed arrow in FIG. 6).

The external thread 16*b* serves to screw on a further sleeve 15*fb* which is disposed on the Bowden cable 15*f*. For this purpose, the sleeve 15*fb* is pushed upward and tightly screwed in a manner known per se, after the thickening 15*fa* has been hooked in.

An elastomer element or the like, in particular an annular seal or O-ring 15*g*, which ensures a sufficient degree of friction in terms of the sleeve 16*a*, is disposed on the external circumference of the sliding part 15*d*. It can be prevented as a result that the drain plug closes itself (cf. FIG. 1, reference sign 20).

FIG. 6 also shows the following in the region of the handling element 13: the actual handling element 13 sits in the manner of a cap on an inner (plastic) part 13*b* having a hollow-cylindrical protrusion 13*cb* which can have a cross section as illustrated. By a suitable selection of the (plastic) material for the part 13*b* and the sizing of the latter in terms of the handling element 13, it can be likewise achieved by ensuring sufficient friction that the drain plug does not close itself (cf. FIG. 1, reference sign 20).

The invention claimed is:

1. A fitting (10), comprising:

a main body (11) which in an assembled state of the fitting (10) protrudes perpendicularly from an assembly face (30);

an activation device for a drain, the activation device interacts with a force-transmission element (15) by way a drain plug (20) is operable, and which activation device comprises a handling element (13) which is disposed on the fitting (10) so as to be movable, relative to a remainder of the fitting (10); and the handling element (13) is movable about an activation axis (B) which is perpendicular to a longitudinal axis (L) of the main body (11), so as to mechanically act on the force-transmission element (15);

wherein the handling element (13) on an internal side thereof facing into the fitting main body (11) has a clearance (17), and the force-transmission element (15) engaging in said clearance (17) by way of a fastening end (15*a*).

2. The fitting (10) as claimed in claim 1, wherein the handling element (13), conjointly with a mixing lever (12) of the fitting (10), is disposed on the activation axis (B) which in the assembled state of the fitting (10) runs parallel to the assembly face (30).

3. The fitting (10) as claimed in claim 1, wherein the handling element (13) has an external circumferential face.

4. The fitting (10) as claimed in claim 3, wherein the external circumferential face is circular-cylindrical.

5. The fitting (10) as claimed in claim 4, wherein the external circumferential face has a display structure (13*a*) for displaying a movement position relative to a remainder of the fitting (10).

6. The fitting (10) as claimed in claim 1, wherein the force-transmission element (15) is at least in portions rigid, and/or is at least in portions flexible.

7. The fitting (10) as claimed in claim 1, wherein the force-transmission element (15) is at least in portions guided within a casing (15*b*, 16*a*).

8. The fitting (10) as claimed in claim 7, wherein the force-transmission element (15) has a sliding part (15*d*), the sliding part (15*d*) is movable within the casing (15*b*, 16*a*), and an elastomer element configured to provide friction in terms of the casing (15*b*, 16*a*) disposed on the sliding part (15*d*).

9. The fitting (10) as claimed in claim 1, wherein the force-transmission element comprises a plurality of at least two parts (15.1, 15.2), which parts (15.1, 15.2) are releasably connected or connectable to one another.

10. The fitting (10) as claimed in claim 1, wherein the force-transmission element (15) is operatively connected mechanically to the handling element (13) at a spacing from the activation axis (B).

11. The fitting (10) as claimed in claim 1, wherein the force-transmission element (15) on the fastening end (15*a*) thereof has a pin (18) which extends perpendicularly to the force-transmission element (15).

12. The fitting (10) as claimed in claim 11, wherein the clearance (17) is curved, and a profile of the clearance (17) deviates from a profile of a circle which is concentric with the activation axis (B).

13. The fitting (10) as claimed in claim 12, wherein the profile of the clearance (17) is longer than a corresponding dimension of the fastening end (15*a*).

14. The fitting (10) as claimed in claim 13, wherein the fastening end (15*a*) is guided in the clearance (17) when the handling element (13) is rotationally activated.

15. A piece of bathroom or kitchen furniture (40), comprising:

a water basin (42) which has a drain that is closed, or closeable, by a drain plug (20);

an assembly face (30) for a fitting (10);

the fitting (10) according to claim 1 assembled on the assembly face (30), and by way of the force-transmission element (15) is connected to at least one of the drain plug (20) or an opening and closing device (21) for the drain plug (20); and wherein the activation axis (B) of the fitting (10) is oriented parallel to the assembly face (30).

16. A method for opening and closing a drain in a piece of bathroom or kitchen furniture (40) having a water basin (42), which drain is closed, or closeable, by a drain plug (20), the method comprising:

a) attaching the fitting (10) as claimed in claim 1 to an assembly face (30) of the piece of furniture (40);

b) connecting the force-transmission element (15) of the fitting (10) to at least one of the drain plug (20) or an opening and closing device (21) for the drain plug (20); and c) moving the handling element (13) of the fitting (10) about the activation axis (B) of the fitting (10), wherein the activation axis (B) of the fitting (10) is oriented so as to be parallel to the assembly face (30).

* * * * *